United States Patent [19]

Van Niel

[11] 4,156,302

[45] May 29, 1979

[54] MONITOR ACTUATING ASSEMBLY AND REUSABLE FASTENER DEVICE THEREFOR

[75] Inventor: Clarence R. Van Niel, North Olmsted, Ohio

[73] Assignee: Eaton Corporation, Cleveland, Ohio

[21] Appl. No.: 884,796

[22] Filed: Mar. 9, 1978

[51] Int. Cl.[2] ..... A44G 9/00; G08B 21/00

[52] U.S. Cl. ..... 24/155 RB; 24/150 R; 24/90 E; 24/110; 340/572

[58] Field of Search ..... 24/90 E, 110, 150 R, 24/155 BB, 155 R, 155 RB; 340/572

[56] References Cited

U.S. PATENT DOCUMENTS

| | | | |
|---|---|---|---|
| 1,338,783 | 5/1920 | Lobar | 24/90 E |
| 1,826,665 | 10/1931 | King | 24/90 E |
| 1,981,813 | 11/1934 | Schuster | 24/90 E |
| 1,987,215 | 1/1935 | Romig | 24/90 E |
| 3,973,418 | 8/1976 | Close | 24/110 |
| 4,000,543 | 1/1977 | Paskert | 24/150 R |
| 4,040,148 | 8/1977 | Fukumoto | 24/110 |

FOREIGN PATENT DOCUMENTS

| | | | |
|---|---|---|---|
| 2539035 | 10/1977 | Fed. Rep. of Germany | 24/90 E |

*Primary Examiner*—Bernard A. Gelak

*Attorney, Agent, or Firm*—R. J. McCloskey; H. D. Gordon

[57] ABSTRACT

A monitor actuating assembly and a reusable fastener device for selective attachment to an article. The assembly, which may carry an alarm actuating element or the like, is readily attachable to the article and is constructed to be released therefrom only by use of a special tool. The reusable fastener device includes a body in which a one-piece, clip-like device is mounted. The body has a pin receiving bore and the clip-like device includes a pair of resilient fingers to frictionally engage the pin for securing the fastener device and, hence, the article to the assembly. The clip-like device is further constructed so as to receive generally radial force from the tool so as to pivot the fingers out of engagement with the pin to enable authorized release of the article from the assembly.

12 Claims, 7 Drawing Figures

MONITOR ACTUATING ASSEMBLY AND REUSABLE FASTENER DEVICE THEREFOR

BACKGROUND OF THE INVENTION

The present invention relates to a monitoring system for detecting the unauthorized movement of an article out of a predetermined area or zone of the type to be maintained under surveillance, and more particularly to a monitor actuating assembly and reusable fastener device therefor of the type for selective attachment and/or removal in respect to a pin element to capture an article such as a garment fabric or the like material, and for non-destructively releasing the same from the pin element only upon use of a special tool.

Conventionally, in such monitoring systems, a fastening device is secured to an identification tag with the assembly, in turn, being temporarily secured to articles prior to the authorized handling and merchandising of such articles, at which time the indentification tag and fastening device can be removed from the article. Hence, such monitoring systems are highly useful for purposes of anti-theft detection in department stores, or the like, where the identification tag must be removed from the article purchased during the check-out process, for example. For instance, if a purchaser attempts to surreptitiously remove the article from the store without actually purchasing the same, the identification tag which remains attached to the article contains monitor actuating means, such as electric circuitry, which may trigger an alarm system at an exit point or points in the store to prevent any potential theft.

Accordingly, it has been known to use various alarms and alarm activating devices attached to such articles to signal the unauthorized removal, as aforesaid. In general, such prior systems have generally included an activating device, such as a magnet, miniature circuit, radio transmitter, or the like, which was releasably attached to the article such that a monitoring device would sound an alarm and/or take a photograph if the activating device is sensed at the monitoring location. In practice, the activating devices should be easily attached to the articles, easily removed by authorized personnel having the proper equipment and very difficult to remove without the proper equipment, especially for the novice shoplifter who is responsible for many thefts. Moreover, the activating devices should be reusable and nondestructive to the articles to which they are attached.

Heretofore, various arrangements have been used to attach such activating devices to articles to be monitored. Heat-releasable devices of both the melted member type and the bi-metallic lever type have been employed. Such heat-releasable devices have not been entirely satisfactory as they have not always been reusable and are oftentimes relatively expensive to manufacture and/or install. In addition, devices using special keys have been employed but have been found to be relatively expensive and are not generally effective against unauthorized personnel familiar with such key-type systems. More recently, various types of attachable clips have been employed which are generally satisfactory for many applications. However, these devices have involved the use of fasteners which are integral with the monitor actuating mechanism and/or include many components which require replacement of the monitor actuating device in the event of damage and/or loss of a portion of the device. Further, such prior clip devices have generally required multi-part constructions utilizing intricate ball and/or cam components which are oftentimes expensive to produce and/or maintain, particularly after harsh and/or repeated usage therof.

Several of these anti-pilferage or anti-shoplifting systems are described in some detail in U.S. Pat. No. 3,911,534, 3,914,829, 3,932,918, 3,942,829, 3,995,900, and 4,000,543.

SUMMARY OF THE INVENTION

In accordance with the present invention, there is provided a monitor actuating device attachment assembly for detecting the unauthorized movement of an article to be monitored, such as a garment fabric or the like, with said assembly comprising a monitor actuating device of the type which may include a magnet, miniature circuit, radio transitter, or the like, for sounding an appropriate alarm system. The assembly includes a pin element having a shaft for piercing said article and attachable to the monitor actuating device. In the invention, a new and improved construction of a reusable fastener device is provided for attachment to the free end of the shaft for securing the article on the shaft with said fastener device including a body having an upper dome member and a lower support member having an axial bore adapted to receive the shaft. The fastener device further includes a resilient one-piece clip-like device mounted within the body and including a pair of oppositely disposed sidewall portions and an inner connecting bridge portion. The bridge portion mounts a pair of resilient fingers defining an opening in general register with the bore, with the fingers acting to engage the shaft upon insertion through the opening and being effective to release the shaft upon application of generally radial force to the sidewall portions for removal of the article from the monitor actuating device. In the invention, the monitor actuating device may generally include a single elongated member which encapsulates the monitor actuating means or may comprise a pair of elongated members which are pivotally attached to one another in the form of an alligator clip, for instance. In another form, a pair of elongated members may be utilized which move vertically relative to one another on a rod. For example, various forms of the case or housing for the monitor actuating device are illustrated in U.S. Pat. No. 4,000,543 assigned to the same assignee as the present application.

From the foregoing description and accompanying drawings, it will be seen that the present invention provides a monitor actuating assembly and reusable fastener device which may be relatively inexpensively produced, and which may be quickly and easily selectively attached to a pin extending from and/or through a monitor actuating device. The reusable fastener device is of an improved construction which includes a one-piece metallic clip-like device which may be positively installed by a simple push-on application for frictional gripping engagement with the pin. In addition, the fastener device is of a relatively simple yet rugged construction which can only be removed by a special tool which simply applies radial force to selective portions of the device for automatically releasing engagement with the pin to enable removal of the assembly from the article for storage and/or subsequent usage. The reusable fastener device is constructed and arranged so that when the pin is attempted to be removed prior to authorized removal, it will further frictionally engage the pin to further insure against unauthorized removal of the article. Further, the assembly is constructed and arranged so as to provide a generally closed construction to prevent access to the interior thereof.

DESCRIPTION OF THE PREFERRED EMBODIMENTS

Figure 1:
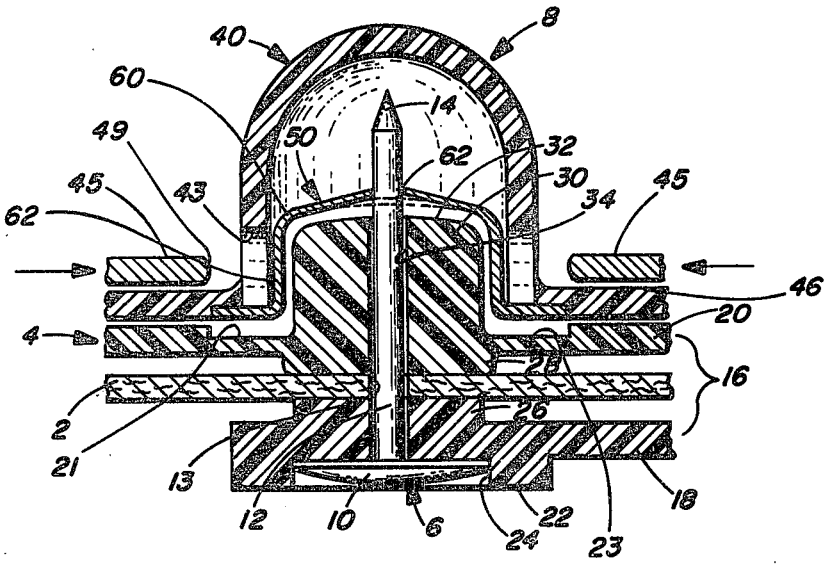
FIG. 1 is a fragmentary, front elevation view, in partial section, of the monitor actuating assembly of the present invention including a pin element illustrated piercing a monitored article and extending through the monitor actuating device with a portion of the specialized tool shown for the removal of the fastener device from the pin element.

Referring now again to the drawings, and in particular to FIG. 1, there is illustrated the monitor actuating system of the present invention. As illustrated, an article to be monitored, generally designated at 2, is attached to a monitor actuating device 4. For example, the article to be monitored may include a fabric clothing, garment article or other piercable type material. The article 2 is attached to the monitor actuating device 4 by means of a headed pin element 6, such as a thumb tack type pin which has the capability to pierce the article to be monitored. The pin element 6 is carried by the monitor actuating device 4 and is adapted to receive the reusable fastener device 8 of the present invention for preventing the removal of the article 2 and/or the actuating device 4 from the pin element 6. By this arrangement, there is provided a reusable monitor actuating system adapted to be secured to an article to be maintained under surveillance for controlling theft from a surveillance zone, such as from retail stores, or the like.

As will best be appreciated from FIG. 1, the pin element 6 includes an enlarged circular head 10 from which extends an integral, axially extending shaft 12 having at its distal end a sharpened point 14 to facilitate piercing of the fabric and/or garment cloth material. In the invention, the shaft 12 has a length sufficient to extend through the article to be monitored 2, the monitor actuating device 4, and through the locking mechanism of the fastener device 8. A substantially identical type pin element is illustrated in U.S. Pat. No. 4,000,543, for example.

In the form illustrated, the monitor actuating device 4 comprises a housing or casing 16 formed of polymeric material, such as plastic, or the like. In this form, the casing 16 includes a pair of mating arms 18 and 20 which may be pivotally attached together at one end (not shown) to form a hinge connection of the type illustrated in FIG. 10 of U.S. Pat. No. 4,000,543. In this arrangement, the pin element 6 extends from the arm 18 which receives the head 10 via a recess 24 provided in an integral upstanding boss 22. In this embodiment, the actuating member, such as a magnet, radio transmitter, radio antenna, or similar device, may be mounted in either arm 18 or 20, as desired. Similar hinge type monitor devices are illustrated in U.S. Pat. Nos. 3,914,829 and 3,942,829. Alternatively, the casing 16 may be of a generally one-piece construction formed by two substantially identical sections joined together, such as by ultrasonic welding, to provide a device which is both durable and economical to produce. Such type of casing is illustrated, for example, in aforesaid U.S. Pat. No. 4,000,543.

Figure 6:
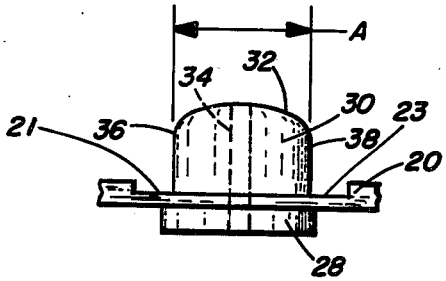
FIG. 6 is a front elevation view of the support member removed from the assembly of FIG. 1.
Figure 7:
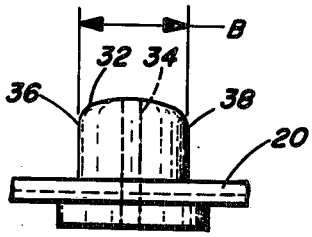
FIG. 7 is an end view looking from the right-hand side of FIG. 6.

Now in accordance with the invention, the reusable fastener device 8 comprises a body assembly 40 and a resilient clip-like fastener device 50 mounted interiorly thereof. In the embodiment illustrated, the body assembly 40 includes an upper dome member 42 disposed over a support member 30. As best seen in FIGS. 1, 6 and 7, the support member 30 is made integral with the arm 20 and is defined by generally parallel side surfaces 36 and 38 with a generally curved upper surface 32 corresponding generally in contour to that of the clip device 50. The arm 20 includes a pair of recesses or slots 21 and 23 (FIGS. 1 and 6) extending across the width thereof adapted to receive flange portions on the fastener device 50, as will be described hereafter.

The support member 30 may include on its lower end an integral base portion 28 which is disposed opposite a corresponding integral base 26 on the confronting arm 18 which coact to provide mating surfaces for hiding the fabric or garment cloth therebetween, as best illustrated in FIG. 1. As seen, the support member 30 is provided with an axially extending bore 34 adapted to slidably receive therethrough shank 12 of the pin element 6. For this purpose, the diameter of the bore 34 is slightly greater than the corresponding diameter of the shaft 12 so as to facilitate assembly of the parts while providing a generally firm and positive inter connection between the component parts of the monitor actuating system.

Figure 2:
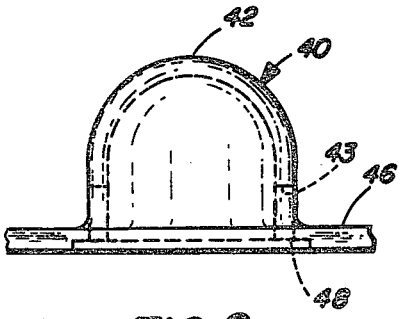
FIG. 2 is a front elevation view of the dome member removed from the assembly of FIG. 1 and on a reduced scale.
Figure 3:
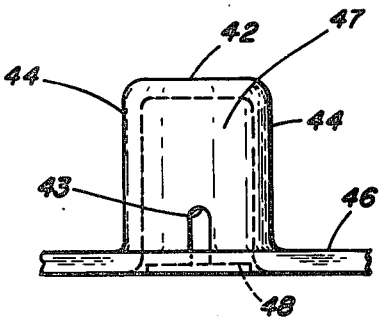
FIG. 3 is an end elevation view looking from the right-hand side of FIG. 2.

As best seen in FIGS. 1, 2 and 3, the dome member 40 includes a pair of generally parallel oppositely disposed side walls 44 and a pair of oppositely disposed parallel end walls 47 (FIG. 3) which, together define a generally polygonal, such a rectangular, configuration in side elevation. The side and end walls are bridged by the generally curved, dome surface 42, which extends upwardly from integral flange portion 46 which together define a base. The dome 42 provides a generally semicylindrical contour which provides a cap-like closure over the pin element 6 and clip-like fastener 50. The base 46 includes a recess or undercut 48 (FIG. 2) adapted to seat (FIG. 1) the flange portions on the fastener device 50. The end walls 47 are provided with generally elongated slots, as at 43, which open onto the bottom so as to receive the jaw elements 45 of a special tool utilized to remove the fastener device 8, as will hereinafter be fully described.

Figure 4:
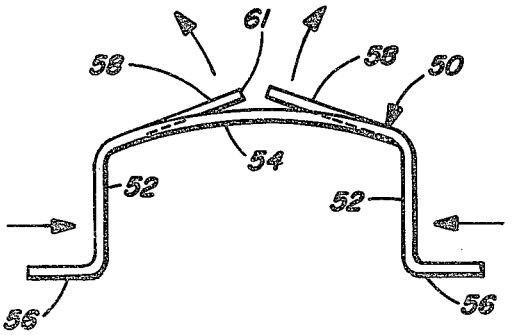
FIG. 4 is a front elevation view of the clip-like fastener device removed from the assembly of FIG. 1.
Figure 5:
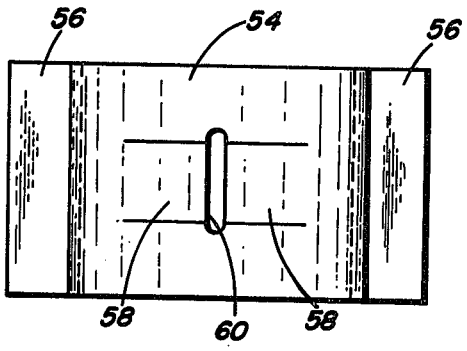
FIG. 5 is a top plan view of the clip-like device of FIG. 4.

Now in accordance with the invention, the clip-like fastener device 50 is of a generally inverted U-shaped configuration defined by a pair of oppositely disposed generally parallel arm portions 52 interconnected by an upwardly bowed or curved bridge portion 54. As best seen in FIG. 4, the bridge portion 54 is of a generally polygonal, such as a rectangular configuration in top plan view (FIG. 5) so as to enclose the support member 30. As best seen in FIG. 1, the bridge portion 50 has generally the same curvature as that of the upper surface 32 of the support member 30. The arms 52 of the device 50 are each provided with integral outwardly extending flange portions 56 (FIG. 4) which extend generally parallel to the arm 20 (FIG. 1) of the case 16 and are adapted to be received in a recess slot 48 (FIG. 2) provided in the dome member 40 to provide a flush interconnection between the contacting under surface of the flange portion 56 and the confronting surfaces of the integral flange portions 46 of the dome member 40.

The bridge portion 54 includes an elongated slot 60 (FIG. 5) defined by an oppositely disposed pair of resilient fingers 58 which are preferably formed by cutting out the material of the bridge portion 54. As best seen in FIG. 4, the resilient fingers 58 are struck out of the material of the bridge portion 54 so as to define a generally inverted V-shaped configuration with the fingers 58 converging upwardly toward one another so as to be spaced rather apart adjacent their distal ends by the slot 60. The distal ends 61 of the fingers define the slot 60 which preferably has a transverse width which is equal to or slightly less than the corresponding transverse dimension (diameter) of the shaft 12 of the pin element 6. By this arrangement, the lead or pointed end 14 of the pin element 6 can readily be inserted through the slot 60 so as to frictionally cam the fingers 58 upwardly and outwardly such that the distal end 61 grip by a biting action, as at 62, into the confronting surface of the shaft 12. Hence, the fastener device 8 is axially restrained against movement relative to the pin element which in turn restrains pivotal movement of the arms 18 and 20 to selectively capture or secure the monitored article 2 therebetween in the closed or monitor actuating device lock position.

In a typical operation, insertion of the shaft 12 of the pin element 6 through the bore 34 will result in the resilient fingers being pivotally deformed upwardly and outwardly away from the bridged portion 54. After insertion, due to the inherent resiliency of the material, the fingers 58 tend to return toward their normal position (FIG. 4) so that their distal edges 61 act to engage and/or penetrate the surface of the shift 12 so as to positively retain the fastener device 8 on the pin element 6. Moreover, efforts to axially force the fastener device 8 from the pin element 6 will result in the fingers 58 being further displaced with respect to the general plane of the bridge portion 54 so as to more effectively engage the shaft 12.

In accordance with the invention, a specially designed tool (not shown) is utilized to remove the fastener device 8 from the pin element 6 for proper removal of the monitor actuating device 4 from the article to be monitored. The tool may be of the type disclosed in the aforementioned U.S. Pat. No. 4,000,543 and may comprise a pair of jaws 45 which are selectively movable along a plane generally parallel to the general plane of the case 16. The jaws may have generally rounded edges 49 so as to engage the confronting surfaces of the side walls 52 of the clip-like fastener 50 upon axial movement through the slots 43 in the dome member 40. Accordingly, upon axial movement of the jaws 45 through the respective apertures 43, the rounded edges 49 apply pressure against the side walls 52 which act to resiliently deform the same toward the confronting surfaces of the support member 30 so that the resilient fingers 58, in turn, are pivoted upwardly and outwardly out of engagement with the confronting surface of the shaft 12 of the pin element 6 for release therefrom. Hence, it will be seen that, while the clip-like fastener 50 is axially fixed relative to the dome member 40, via engagement of the flange portions 46 within the recess 48, the side walls 52 may be resiliently deformed inwardly and outwardly upon relative inward and outward movement of the jaws 45 upon release and/or installation of the monitor actuating device 4. Accordingly, for this purpose, it will be seen that the support member 30 and fastener device 50 have generally complemental configurations with the same being slightly vertically spaced (FIG. 1) to enable resilient deformation of the clip-like fastener. This spacing is illustrated generally at 60 which defines a space corresponding in configuration to that of the associated transverse cross-section of the clip-like fastener 50. Similarly, it is preferred that the side walls 52 be laterally spaced slightly away from the confronting inner surface of the dome member 42, as at 62, to facilitate resilient movement of the side walls toward and away from the confronting surface of the support member 30.

In the invention, is is understood that alternate cross-sectional shapes may be employed for the pin shaft 12 as well as for the specific shape of the slot 60 defined by the resilient fingers 58. Further, it will be understood that the terms upper, lower, top, bottom, upward, downward, and the like, are used merely as terms of description referring to the drawings and are not intended to limit the scope of the invention as recited in the presented claims.

I claim:

1. A monitor actuating device attachment assembly for detecting the unauthorized movement of an article to be monitored such as a garment fabric or the like, said assembly comprising:

a monitor actuating device, a pin element having a shaft for piercing said article and attachable to said monitor actuating device, a selectively releasable reusable fastener device for attachment to the free end of said shaft for securing said article on said shaft, said fastener device including, a body having an upper dome member and a lower support member having an axial bore adapted to receive said shaft, a resilient one-piece, generally inverted U-shaped clip-like device mounted within said body including a pair of oppositely disposed side wall portions and an interconnecting bridge portion, and said bridge portion having a pair of resilient fingers defining an opening disposed in general register with said bore, said fingers acting to engage said shaft upon insertion through said opening and being effective to release said shaft upon application of generally radial force to each of said side wall portions for removal of said article from said monitor actuating device.

2. A monitor actuating assembly in accordance with claim 1, wherein, said side wall and bridge portions being spaced outwardly from said support member with said radial force being effective to move said side wall portions inwardly so as to pivot said fingers upwardly and outwardly out of engagement with said shaft.

3. A monitor actuating assembly in accordance with claim 1, wherein, said monitor actuating device comprises a molded case of polymeric material encapsulating a monitor actuating means, and said pin element is made integral with and extending from said case.

4. A monitor actuating assembly in accordance with claim 1, wherein, said pin element extends from adjacent the free end of a first elongated member pivotally attached to a second elongated member, said fastener device is attached to the free end of said second elongated member, and said monitor actuating means is encapsulated in one of said elongated members.

5. A reusable selectively releasable fastener device of the type for attachment to the end of a shaft or the like for releasable connection to an article to be monitored, said device comprising:

a generally hollow body including an upper dome member and a lower support member, said lower support member having a axial bore adapted to receive said shaft therethrough, a resilient one-piece clip disposed within said body, said clip having a generally inverted U-shaped body in cross section comprising a pair of oppositely disposed side wall portions and a bridge portion interconnecting said sidewall portions, said bridge portion including a pair of resilient fingers defining an opening therebetween disposed in general register with said bore for receipt of said shaft and gripping engagement by said fingers in the installed position thereof, said side wall portions being spaced from said support member and radially inwardly directed forces on each of said wall portions being effective to move the same radially inwardly so as to pivot said fingers upwardly and outwardly out of engagement with said shaft.

6. A reusable fastener device in accordance with claim 5 wherein, said side wall portions include integral outwardly extending flange portions disposed for abutment with confronting surface portions of sid dome member to substantially restrain axial movement of said clip in respect to said hollow body.

7. A reusable fastener device in accordance with claim 6, wherein, said resilient fingers are formed from the material of said bridge portion and extend angularly upwardly and inwardly toward one another, and the free end edges of said fingers being laterally spaced apart a distance less than the corresponding transverse dimension of said shaft.

8. A reusable fastener device in accordance with claim 7, wherein, said resilient fingers extend linearly in convergent relation toward one another so as to be disposed at an acute angle in respect to the general horizontal plane of said bridge portion.

9. A reusable fastener device in accordance with claim 8, wherin, said side wall portions are disposed generally parallel to one another, and said bridge portion being generally arcuate in end elevation.

10. A reusable fastener device in accordance with claim 7, wherein, said support member has a cross-sectional shape generally corresponding in shape to the associated cross-sectional shape of said clip.

11. A reusable fastener device in accordance with claim 10 wherein, said side wall and bridge portions are spaced from said support member a distance sufficient to enable pivotal movement of said fingers out of engagement with said shaft upon application of generally oppositely directed radial forces to said side wall portions.

12. A reusable fastener device in accordance with claim 6, wherein, said dome member is of a generally inverted U-shaped configuration in front elevation having at least two generally radially opening aperture means adapted to receive tool means for applying force to said side wall portions.

* * * * *